United States Patent [19]

Podosek

[11] Patent Number: 4,919,557

[45] Date of Patent: Apr. 24, 1990

[54] LOOSELEAF BINDER WITH SLIDING LOCK MECHANISM

[75] Inventor: Edward Podosek, Wilbraham, Mass.

[73] Assignee: Dennison Manufacturing Company, Framingham, Mass.

[21] Appl. No.: 257,658

[22] Filed: Oct. 14, 1988

[51] Int. Cl.[5] ..... B42F 13/20; B42F 3/04; B42F 13/16; B42F 5/00

[52] U.S. Cl. ..... 402/41; 402/38; 402/37; 402/36

[58] Field of Search ..... 402/33, 36, 37, 38, 402/41, 42, 46

[56] References Cited

U.S. PATENT DOCUMENTS

| | | | |
|---|---|---|---|
| 134,724 | 1/1873 | Billow | 402/36 |
| 1,001,539 | 8/1911 | Loud | 402/33 |
| 2,179,627 | 11/1939 | Handler | 402/33 |
| 3,098,489 | 7/1963 | Vernon | 402/37 |
| 4,566,817 | 1/1986 | Barrett, Jr. | 402/38 |
| 4,571,108 | 2/1986 | Vogl | 402/38 |
| 4,813,803 | 3/1989 | Gross | 402/33 |

FOREIGN PATENT DOCUMENTS

| | | | |
|---|---|---|---|
| 14015 | 4/1914 | United Kingdom | 402/41 |

*Primary Examiner*—Douglas D. Watts
*Assistant Examiner*—Paul M. Heyrana, Sr.
*Attorney, Agent, or Firm*—Arthur B. Moore

[57] ABSTRACT

A locking loose-leaf binder mechanism which has a curved housing retaining two hookplates, to which binder rings are attached. A control slide attached to each end of the housing includes one or two cam surfaces to engage the hookplates. In an embodiment incorporating two cam surfaces, one cam surface locks the binder rings in a closed position when the slides are fully retracted into the coverplate, and a second cam surface similarly locks the rings when the slides are fully extended from the coverplate. When the slides are neither fully extended nor retracted, the cam surfaces are in a neutral position and the rings may be opened. In further embodiments of the invention, a single cam surface may be employed, either to lock the rings when the slides are fully extended, or fully retracted. Each control slide end further includes a specially formed hanger tab to suspend the binder on a file-frame when the control slides are fully extended. This provides a rigid means to store the binder in a securely locked, inverted orientation. Binder appplications which do not require file-frame hanging capability may be fitted with only a single control slide.

20 Claims, 4 Drawing Sheets

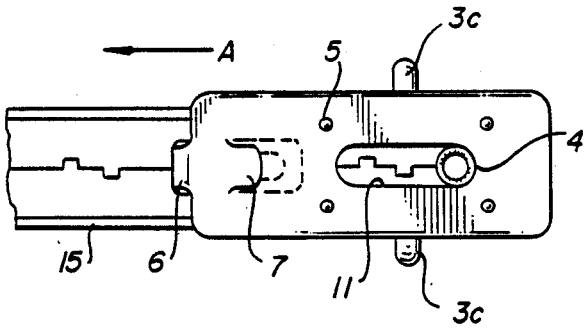
FIG. 4
FIG. 5
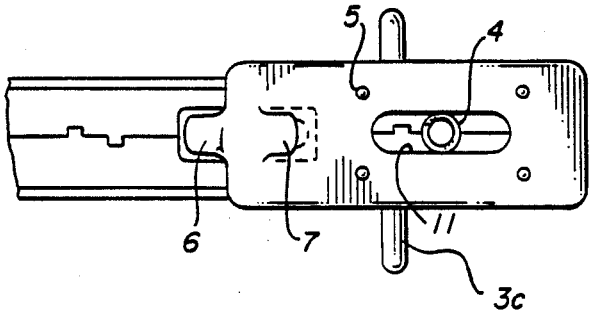
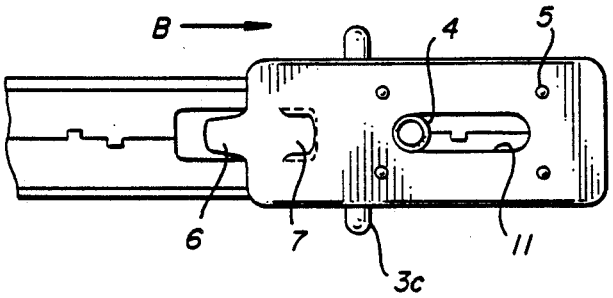
FIG. 6
FIG. 7
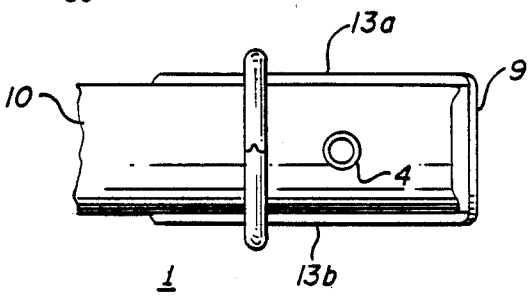

LOOSELEAF BINDER WITH SLIDING LOCK MECHANISM

BACKGROUND OF THE INVENTION

This invention pertains to improvements in loose-leaf binders. More particularly, this invention pertains to improvements in loose-leaf binders of the type employing a plurality of aligned ring-pairs mounted to elongated, resilient hookplates retained by a curved coverplate. The hookplates are pivotable along the longitudinal axis defined by the outer edges of each plate. The inner edges of the plates are joined in a hinged relationship such that the plates are positionable in an inwardly bowed orientation toward the coverplate and an outwardly bowed orientation away from the coverplate. In these respective positions, the binder rings which are mounted to the hookplates are accordingly in an open or closed orientation.

It is desirable to provide means for reliably locking binder rings in the closed position to avoid accidental opening and possible damage to or loss of materials stored in the binder. Various forms of locking apparatus have been incorporated in loose-leaf binder mechanisms, as described in U.S. Pat. Nos. 2,061,676, 2,105,235, 2,950,719, 3,077,888, 3,098,490, 3,884,586 and 4,566,817. These prior art devices are generally effective in providing binder locking capability, however all are constructed of more than one component and require several assembly operations to manufacture.

It may be desirable to provide means for suspending a binder in an inverted orientation from a file-frame unit such as a Pendaflex® system. (Pendaflex is a registered trademark of Esselte Pendaflex Corp.). Past efforts in providing this capability have generally utilized two basic approaches: the first approach has been to provide an extendable arm at each end of the binder. The arm generally has been mounted in channels or tracks attached to or constructed as part of the coverplate. The second approach has been to provide permanently mounted tabs which extend from each end of the binder. This second approach has the significant drawback of preventing the storage of the binder on a shelf in an upright position, such as a book is stored on a library shelf. Both approaches are characterized by the requirement for several components, adding to the cost and complexity of manufacturing the binder mechanism.

It will be appreciated that when the binder is suspended in an inverted orientation the resulting weight of the materials upon the binder rings almost always mandates that some type of lock is utilized to secure the rings in the closed position.

It is with these considerations that the present invention was developed. The primary object is to provide a reliable binder locking means which also functions as a rigid file-frame hanger. The hanger is fully retractable to allow the binder to also be stored in an upright position on a shelf.

Another object of the present invention is to provide a dual-function binder mechanism locking and hanging capability with a single component which is readily formed, low in cost, and extremely easy to manufacture.

A related object of the present invention is to provide through the use of the same mass-producible component, means for producing a low-cost, reliable, locking binder mechanism for applications which do not require the capability for file-frame storage.

SUMMARY OF THE INVENTION

In furthering the above and related objects, an improved locking-ring, file-frame suspendable loose-leaf binder mechanism is provided. Loose-leaf pages and other materials are retained within binder rings, which can be locked by control slides located at each end of the binder coverplate. Alternatively, the control slide may omit the hanger tab, and serve only a locking function without including a tab for suspension of the binder. The improvement is embodied in a slideably mounted control slide attached to each end of the covered, elongated coverplate of a conventional ring binder mechanism of the type wherein a plurality of opposing rings are mounted to two elongated, hinged hookplates retained by the coverplate. The control slides each include either two cams to lock the binder mechanism, or a single cam. In the first, two-cam embodiment locking occurs either in the extended or retracted positions. In the single cam case, a second embodiment locks the binder while the slide is in its extended position, while a third embodiment locks in the retracted position.

In a first embodiment of the invention, the control slide includes two cam surfaces which engage the hookplates through a rectangular opening formed at the abutting edges of the hookplates. The locking of closed bindmer rings occurs when, in the case of the control being fully retracted into the coverplate, the hookplates are engaged in a outwardly-bowed orientation by the wedged-in position of the cam and against the top center region of the hookplates adjacent to the first hookplate opening.

Binder rings are similarly locked in closed position by the second cam when the control slide is fully extended and the cam engages the hookplates in cooperation with the second hookplate opening. In the fully extended position, the control slide hanger tabs provide suspension capability for the binder on a file-frame. The tabs are so constructed to hook over each suspension bar on a file-frame, securely hanging the binder at an appropriate level in the filing system.

When a binder is stored in an inverted position on a file-frame, the binder rings support all of the weight of the loose-leaf pages in the binder. In particular, when the binder is relatively full, the weight of the loose-leaf pages will be considerable, resulting in a tendency for the rings open at the center, where the weight is most concentrated.

It will be appreciated that with the construction of the improvement as described, the fully extended control slides are further locked in position by the weight of the binder on the tab ends, which are hooked over the outside edges of the file-frame. In this position, the control slide cams are fully engaged with the hookplates, thereby ensuring that the binder rings are positively locked in the suspended binder position.

The second and third embodiments of the invention utilize only a single cam on each of the control slides. In the second embodiment, the rings are locked when the slide is pushed in (retracted). Each control slide incorporates an inwardly extending wedge which engages a hook plate in such retracted position. In the third embodiment, locking occurs when the control slide is extended. An outwardly extending wedge on each slide engages a hook plate in such extended position. In this situation, the control slide may also act as a suspension device for the binder in a vertical file feature (as in the first embodiment).

The invention encompasses dual function slide plates which incorporate hanger tabs for suspending binders on a file frame, and single function control slides which are not used to suspend the binders.

BRIEF DESCRIPTION OF THE DRAWINGS

The above and additional aspects of the invention are illustrated with reference of the detailed description which follows, taken in conjunction with the drawings in which:

FIG. 4 is a bottom sectional view of the binder mechanism in FIG. 1, with the control slide in the fully retracted position and the binding rings closed;

FIG. 5 is a bottom sectional view of the binder mechanism in FIG. 1, with the control slide in the intermediate position and the binding rings open;

FIG. 6 is a bottom sectional view of the binder mechanism in FIG. 1, with the control slide in the fully extended position and the binding rings closed;

FIG. 7 is a top sectional view of the binder mechanism in FIG. 1, with the control slide in the fully retracted position and the binding rings closed;

DETAILED DESCRIPTION

Reference shouold now be had to FIGS. 1–7 which illustrate a ring binder mechanism in accordance with a first embodiment of the invention. Such first embodiment is characterized as that control slides for selectively locking the binder each incorporate two cams for dual locking positions. (Second and third embodiments, which incorporate a single cam in each slide and involve single locking positions, are discussed further below).

Figure 1:
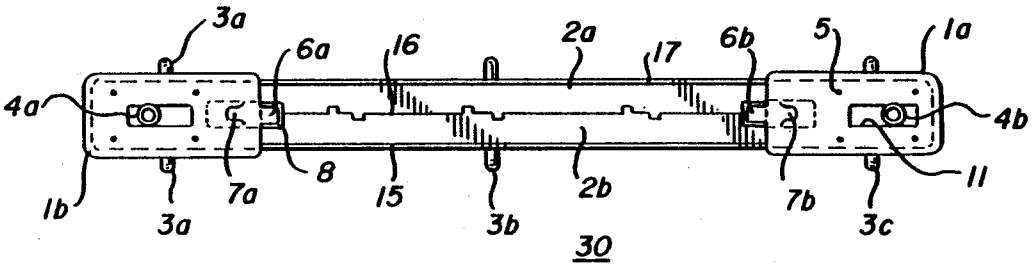
FIG. 1 is a bottom sectional view of a locking binder mechanism with retractable hangers, in accordance with a first embodiment.
Figure 2:
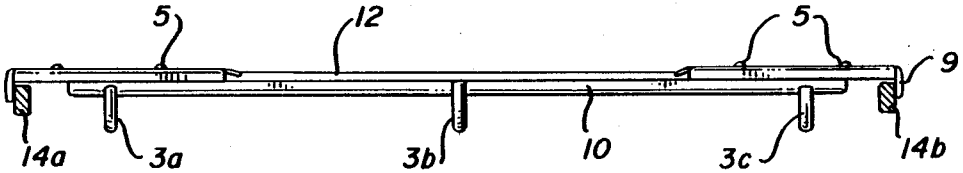
FIG. 2 is a partial side view of the binder mechanism in FIG. 1, as suspended upon a file-frame.

With reference to FIGS. 1 and 2, improved loose-leaf binder mechanism includes, as in conventional ring binders, a curved, elongated coverplate 10. The coverplate 10 retains two elongated hookplates 2*a* and 2*b*, which are disposed in a hinged relationship at the centerline of the coverplate, and which may assume an inwardly-bowed or outwardly-bowed orientation toward the top of the coverplate. A plurality of opposing binder rings 3*a*–3*c* are affixed to the hookplates. Opposing rings 3*a*–3*c* assume an open or closed position in relation to each other as the hookplates are positioned in an inwardly-bowed to outwardly-bowed orientation, respectively. The binding mechanism of the present invention incorporates, in addition to these conventional elements, control slides 1*a* and 1*b*, cam surfaces 6 and 7, and coverplate eyelets 4*a* and 4*b*.

Hookplates 2*a* and 2*b* are pivotally mounted within coverplate 10, with the outer longitudinal edge 17 of each hookplate pivotally mounted against the inner edge of coverplate 10. The inner longitudinal edges 16 of the hookplates are joined in a hinged relationship along the center line of the coverplate. With this arrangement, the hookplates are positionable in an inwardly-bowed orientation toward the coverplate and an outwardly-bowed orientation away from the coverplate.

The mechanism 30 includes at least one ring binding means having two opposing portions 3*a* and 3*b*, each of the opposing portions affixed to opposite hookplates in alignment with the other portion. Customary means for moving the hookplates between an inwardly-bowed and an outwardly-bowed orientation are levers (not illustrated), located at one or both ends of the coverplate. It is of course possible to move the opposing portions of the binding means from an open position to a closed position (and vise versa) by direct manipulation, which will "snap" the hookplates from one orientation to the other.

Figure 3:
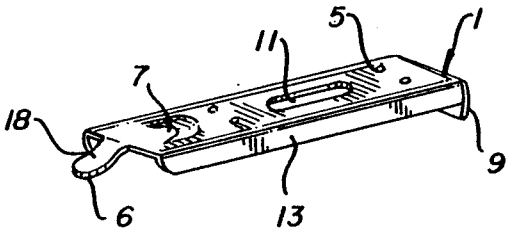
FIG. 3 is a perspective view of the control slide component of the binder mechanism in FIG. 1.

Continuing now with reference to FIGS. 1,3 and 7, control slide 1 of the first embodiment will now be described. As can be seen in FIG. 3, the control slide is substantially rectangular in shape. A positioning tab 9 located at the end of the control slide is formed to extend above the end of the coverplate. The tab is used to move the slides, and to suspend the binder over file-frame members 14*a* and 14*b*, as depicted in FIG. 2.

Control slide 1 is mounted to the coverplate 10 by employing slot 11. Eyelet 4 extending through the top of the coverplate passes through the slot. The length of the slot, in cooperation with the eyelet, limits travel of the slide longitudinally in both the extended and retracted positions.

Engagement of the outwardly-bowed hookplates by structures located on the control slide results in locking of the binder rings. These engagement structures comprise two cam surfaces 6 and 7, oriented in opposite directions, and located at the end of the control slide opposite from the slide positioning tab 9 end. Each cam surface includes a hookplate engagement area 18 between the cam end and the control slide member, the area being parallel with the top of the hookplates and conforming substantially to the outwardly-bowed shape of the hinged hookplate region. This conformity evenly distributes hookplate retaining forces against the hookplate, and securely locks the control slide in position. The cam will not be wedged out by the pressure of the hookplates.

The hookplates are constructed with squared notchs 8 at each opposing inner longitudinal edge of the hookplate, resulting in a substantially rectangular hole at the abutting relationship of the hookplates, in proximity of control slide cam ends and engagement surfaces. The notches enable the cam surfaces to travel between the hookplates and the coverplate to engage, thereby locking, the hookplate surfaces.

As depicted in FIG. 6, when the control slide is fully extended, in Direction B, the cam surface located at the end of each control slide proximate to the slide positioning tab is actuated. Conversely, when the control slide is fully retracted in Direction A, as depicted in FIG. 4, the cam surface at the outer end of the control slide is actuated. FIG. 5 illustrates the neutral, unlocked position.

Importantly, when the binder is hung in an inverted orientation, the weight of the binder, in cooperation with the tab ends which are positioned on the outside of the file-frame members, effectively safety-locks the slides.

Alignment of the control slide along the longitudinal axis is mantained by the side edges 13 of the control slide which extend slightly above the side of the outer longitudinal edge of the coverplate, at an approximate 90° angle. These edges add considerable structural strength to the control slide, for reliable service when extended for suspension on a file-frame.

The control slide is slideably seated against the turned longitudinal bottom-edges 12 of the coverplate. These edges, which are turned inward, provide a smooth seating surface. On the bottom face of the control slide are a plurality of rounded raised areas 5 to minimize frictional contact between the control slide and material to which the binder mechanism is attached typically, a backbone which is riveted to the mechanism through the coverplate eyelet holes.

It can be seen that the invention obviates the need for an intricate locking assembly, while providing reliable operation.

Figure 8:
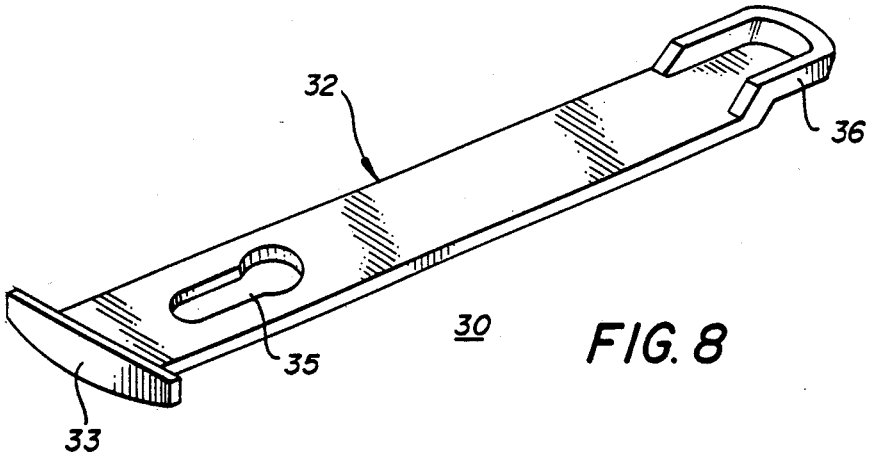
FIG. 8 is a perspective view of a control slide two of which are incorporated in a locking binder of a second embodiment of the invention.
Figure 9:
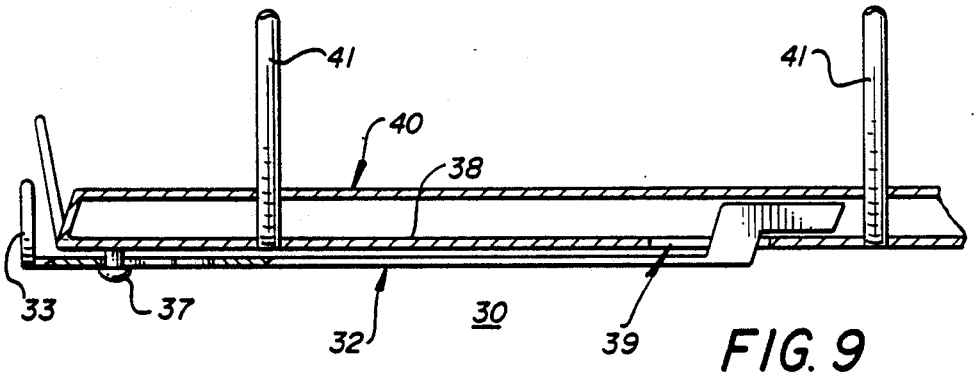
FIG. 9 is a cross-sectional view of one end of a binder utilizing the control slide of FIG. 8, in the locked position.
Figure 10:
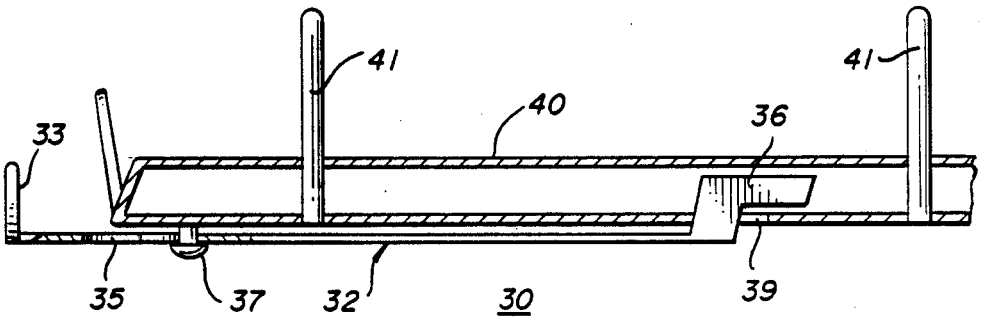
FIG. 10 is a cross-sectional view of the binder of FIG. 9, in an unlocked position.

Now having reference to FIGS. 8–10, a second binder mechanism embodiment 30 incorporates a pair of control slides (only one seen at 32 in these Figures) which are configured to lock the binder when the slides are in their retracted (inward) position. Slide 32 is seen in perspective in FIG. 8, and includes an end flange 33, keyhole aperture 35, and wedge 36. Keyhold aperture 35 slidably engages a rivet or other structure 37 on the hook plate 38, and may be inserted or removed by aligning the rivet with the enlarged portion of the aperture. Wedge 36 extends upwardly through an opening 39 in hook plate 38, and projects inwardly so that the wedge locks the binder mechanism wherein the control slide 32 is in its retracted (inward) position (compare FIGS. 9 and 10).

Figure 11:
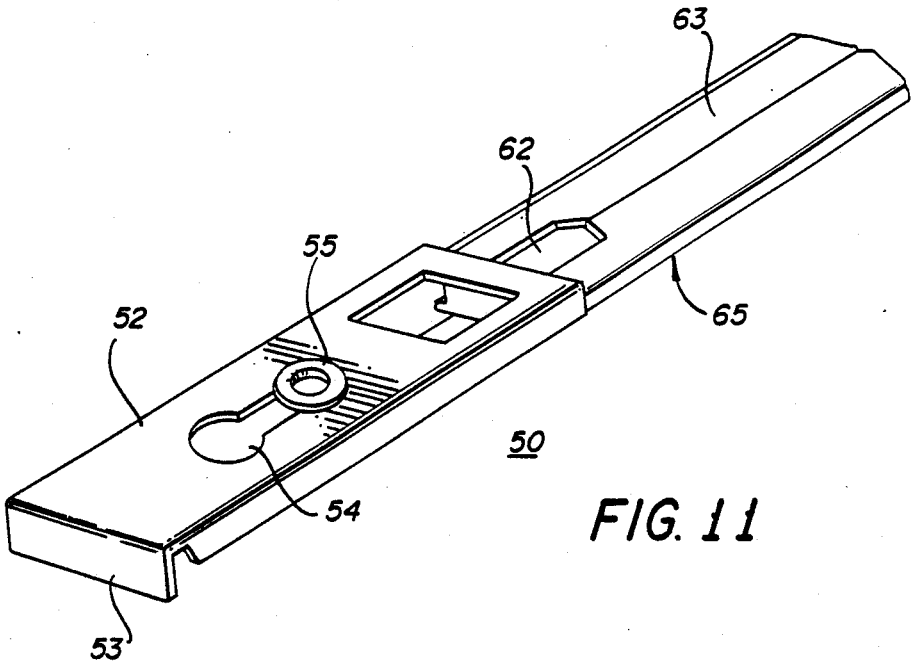
FIG. 11 is a perspective view of a control slide and hook plate from a binder in accordance with a third embodiment of the invention.
Figure 12:
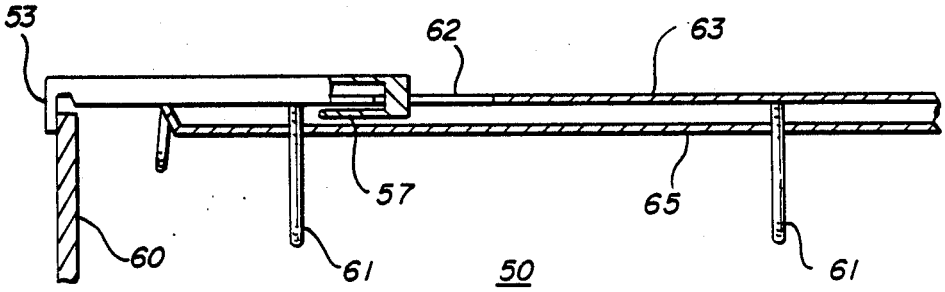
FIG. 12 is a cross-sectional view of a binder mechanism incorporating the control slide of FIG. 11.

FIGS. 11 and 12 illustrate a third binder embodiment 50 incorporating a control slide 52 (at each end of the binder) which is designed to lock the rings in place when the control slide is in its extended position. Control slide 52 is slidably mounted through the engagement of keyhole aperture 54 with rivet 55. Slide 52 includes a cam wedge 57 which projects out of the plane of the slide as shown in FIG. 12 so that it may jet through an opening 62 in hook plate 63. Furthermore, in contract to the embodiment of FIGS. 8–10, cam wedge 57 extends outwardly of the binder, so that it is when the control slide is in its extended position that the wedge 57 fits between the hook plate 63 and cover plate 65 to lock the rings. End flange or tab 53 of slide 52 can be used to suspend the binder 50, e.g. in a file drawer 60, when the slide is in its extended, locked position as seen in FIG. 12.

I claim:

1. A loose-leaf binding mechanism, of the type affixed to covers and a backbone structure, comprising:

a coverplate adapted to be affixed to a backbone structure and having an upper wall extending the length of said coverplate and spaced apart from the backbone structure;

a pair of hook plates, each hook plate pivotally coupled to said coverplate for movement between a first position with said hook plates positioned in proximity to said coverplate and a second position with said hook plates positioned distally from said cover plate, said hook plates including an aperture;

ring binding means having two opposing portions, each of said opposing portions affixed to opposite hook plates in cooperating relationship to open and close with the movement of said hook plates;

locking slide slidably affixed in said coverplate, movable between a first locking slide position at which the locking slide projects from one end of the backbone, and a second locking slide position at which the locking slide does not substantially project from such end;

wherein said locking slide includes a body portion which is slidable between the hook plates and the backbone, and a cam arm which extends through the hook plate aperture as the locking slide moves between the first locking slide position and the second locking slide position, said cam arm having a wedge portion which is configured to wedge between the hook plates and the coverplate when the hook plates are in their second position only when the locking slide is at or near its first locking slide position, to prevent the pivotting of said hook plates to their first position and the opening of the ring binding means.

2. A binding mechanism as defined in claim 1 further comprising means for urging said hinge plates between their first and second positions and thereby opening and closing the ring binding means, said urging means not including said locking slide.

3. A binding mechanism as defined in claim 1, including two locking slides, one at each end of said backbone, wherein said hook plates include an aperture for each locking slide.

4. A binding mechanism, as defined in claim 1, wherein said locking slide includes at its end which projects furthest from the backbone a tab member which may be used to engage the locking slide.

5. A binding mechanism as defined in claim 4, including a locking slide at each end of the backbone, wherein the tab portions of the locking slides are configured to suspend the notebook from a file-frame.

6. A binding mechanism as defined in claim 5, including a locking slide at each end of the backbone, wherein the tab portions of the locking slides are configured to suspend the notebook from a file-frame.

7. A binding mechanism as defined in claim 1, wherein the body portion of the locking slide includes flanges which are seated against longitudinal edges of the cover plate for sliding movement.

8. A binding mechanism as defined in claim 1, wherein the body portion of the locking slide includes raised surfaces which reduce frictional contact between the body portion and the backbone.

9. A loose-leaf binding mechanism, of the type affixed to covers and a backbone structure, comprising:

a coverplate adapted to be affixed to a backbone structure and having an upper wall extending the length of said coverplate and spaced apart from the backbone structure;

a pair of hook plates, each hook plate pivotally coupled to said coverplate for movement between a first position with said hook plates positioned in proximity to said coverplate and a second position with said hook plates positioned distally from said cover plate, said hook plates including an aperture;

ring binding means having two opposing portions, each of said opposing portions affixed to opposite hook plates in cooperating relationship to open and close with the movement of said hook plates;

a locking slide slidably affixed in said coverplate, movable between a first locking slide position at which the locking slide projects from one end of the backbone, and a second locking slide position at which the locking slide does not substantially project from such end;

wherein said locking slide includes a body portion which is slidable between the hook plates and the backbone, and a cam arm which extends through the hook plate aperture as the locking slide moves between the first locking slide position and the second locking slide position, said cam arm having a wedge portion which is configured to wedge between the hook plates and the coverplate when the hook plates are in their second position only when the locking slide is at or near its second locking slide position, to prevent the pivotting of said hook plates to their first position and the opening of the ring binding means.

10. A binding mechanism as defined in claim 9 further comprising means for urging said hinge plates between their first and second positions and thereby opening and closing the ring binding means, said urging means not including said locking slide.

11. A binding mechanism as defined in claim 9, including two locking slides, one at each end of said backbone, wherein said hook plates include an aperture for each locking slide.

12. A binding mechanism, as defined in claim 9, wherein said locking slide includes at its end which projects furthest from the backbone a tab member which may be used to engage the locking slide.

13. A binding mechanism as defined in claim 12, including a locking slide at each end of the backbone, wherein the tab portion of the locking slides are configured to suspend the notebook from a file-frame.

14. A binding mechanism, as defined in claim 9, wherein said locking slide includes at its end which projects furthest from the backbone a tab member which may be used to engage the locking slide.

15. A binding mechanism as defined in claim 9, wherein the body portion of the locking slide includes flnages which are seated against longitudinal edges of the cover plate for sliding movement.

16. A binding mechanism as defined in claim 9, wherein the body portion of the locking slide includes raised surfaces which reduce frictional contact between the body portion and the backbone.

17. A loose-leaf binding mechanism, of the type affixed to covers and a backbone structure, comprising:

a coverplate adapted to be affixed to a backbone structure and having an upper wall extending the length of said coverplate spaced apart from the backbone structure;

a pair of hook plates, each hook plate pivotally coupled to said coverplate for movement between a first position with said hook plates positioned in proximity to said coverplate and a second position with said hook plates positioned distally from said cover plate, said hook plates including an aperture;

ring binding means having two opposing portions, each of said opposing portions affixed to opposite hook plates in cooperating relationship to open and close with the movement of said hook plates;

a locking slide slidably affixed in said coverplate, movable between a first locking slide position at which the locking slide projects from one end of the backbone, and a second locking slide position at which the locking slide does not substantially project from such end;

wherein said locking slide includes a body portion which is slidable between the hook plates and the backbone, and two cam arms which extend through the hook plate aperture as the locking slide moves between the first locking slide position and the second locking slide position, said cam arms having respective wedge portions which are configured to wedge between the hook plates and the coverplate when the hook plates are in their second position only when the locking slide is at or near either its first locking slide position or second locking slide position, to prevent the pivotting of said hook plates to their first position and the opening of the ring binding means.

18. A binding mechanism as defined in claim 17 further comprising means for urging said hinge plates between their first and second positions and thereby opening and closing the ring binding means, said urging means not including said locking slide.

19. A binding mechanism as defined in claim 17, including two locking slides, one at each of said backbone, wherein said hook plates include an aperture for each locking slide.

20. A binding mechanism as defined in claim 17, wherein the body portion of the locking slide includes flanges which are seated against longitudinal edges of the cover plate for sliding movement.

* * * * *